US007563202B1

(12) United States Patent
Sudeith

(10) Patent No.: US 7,563,202 B1
(45) **Date of Patent: *Jul. 21, 2009**

(54) CLIMBING WALL ASSEMBLY

(75) Inventor: Timothy S. Sudeith, Edina, MN (US)

(73) Assignee: Everlast Climbing Industries, Inc., Mendota Heights, MN (US)

( * ) Notice: Subject to any disclaimer, the term of this patent is extended or adjusted under 35 U.S.C. 154(b) by 364 days.

This patent is subject to a terminal disclaimer.

(21) Appl. No.: 11/280,899

(22) Filed: Nov. 16, 2005

Related U.S. Application Data

(63) Continuation-in-part of application No. 10/236,728, filed on Sep. 6, 2002, now Pat. No. 7,056,266.

(60) Provisional application No. 60/628,458, filed on Nov. 16, 2004, provisional application No. 60/317,726, filed on Sep. 6, 2001.

(51) Int. Cl.
*A63B 7/00* (2006.01)

(52) U.S. Cl. ..... 482/37

(58) Field of Classification Search ..... 482/8, 482/35–37, 23, 148; 182/129–130
See application file for complete search history.

(56) References Cited

U.S. PATENT DOCUMENTS

| | | | | |
|---|---|---|---|---|
| 5,254,058 | A | 10/1993 | Savigny | |
| 5,732,954 | A * | 3/1998 | Strickler et al. | 273/441 |
| 5,944,634 | A | 8/1999 | Neves | |
| 6,074,327 | A * | 6/2000 | Franklin | 482/37 |
| 6,083,142 | A * | 7/2000 | Wilson | 482/37 |
| 6,231,482 | B1 * | 5/2001 | Thompson | 482/37 |
| 6,705,972 | B1 * | 3/2004 | Takano et al. | 482/8 |
| 6,709,365 | B2 * | 3/2004 | Zeilinger | 482/35 |
| 7,114,592 | B1 * | 10/2006 | Gibson et al. | 182/129 |

* cited by examiner

*Primary Examiner*—Fenn C Mathew
(74) *Attorney, Agent, or Firm*—Anthony G. Eggink; Katrina M. Eggink

(57) ABSTRACT

A climbing wall assembly for educational and recreational purposes. The climbing wall assembly has a plurality of adjacently positioned wall panels, each having an exterior surface adapted for educational purposes. A plurality of wall apertures are provided for mounting hand hold structures so that a plurality of climbing paths may be provided. Markable metallic and magnetic wall panel surfaces are provided so that the climbing paths may be marked. Removable magnetic and metallic educational elements may also be utilized by the climbers. A paint layer with metallic or magnetic particles mixed therein may be utilized to provide the magnetic climbing wall surface and to provide magnetic qualities to climbing wall components.

17 Claims, 11 Drawing Sheets

CLIMBING WALL ASSEMBLY

This application is a Continuation-in-Part of U.S. patent application Ser. No. 10/236,728, filed on or about Sep. 6, 2002, now U.S. Pat. No. 7,056,266 issued on Jun. 6, 2006, and claims the benefit of U.S. Provisional Patent Application Ser. No. 60/317,726, filed on or about Sep. 6, 2001, and U.S. Provisional Patent Application Ser. No. 60/628,458, filed on or about Nov. 16, 2004.

BACKGROUND OF THE INVENTION

The present invention relates generally to climbing wall assemblies and particularly to climbing wall assemblies that are utilized for educational and recreational purposes. More particularly, this invention relates to climbing wall assemblies comprised of wall panels having exterior surface structures adapted for use with associated removable educational element structures.

The rock climbing and bouldering sports have become increasingly popular activities. As a result, artificial climbing and bouldering walls are increasingly being used for training purposes by climbers. The climbing wall assemblies of the present invention are provided to introduce children into the climbing sports in a safe and educational manner.

The climbing wall assemblies of the invention are constructed and arranged for educational climbing wall activities. The climbing wall assemblies are comprised of versatile, cooperating elements which provide the ability to create a plurality of climbing routes to be used by climbers. The elements may be easily changed and adjusted to provide a variety of educational climbing activities. The climbing wall assemblies of the invention are economical to manufacture, easy to install and are versatile in use.

The climbing wall assemblies of the invention may be comprised of wall panels to create climbing walls. Wall plates and hand holds are mounted to the wall panels or climbing wall structures. The wall panels are constructed and arranged to be mounted to a load bearing structure such as a wall of a building or a free standing structure, for example. The climbing wall assemblies may include adjoining writing board wall panels having smooth surfaces, i.e., a "chalkboard" or a "white board" surfaces, including those having metallic and magnetic properties for receiving erasable markings. The climbing wall assemblies may include adjoining molded wall panels having metallic or magnetic surface properties for use with magnetic or metallic educational elements. Alternatively, a paint or coating layer having metallic or magnetic particles may be applied to a climbing wall or other climbing wall component, i.e., a hand hold, wall plate or educational element structure.

The climbing wall assembly may also incorporate the use of wall plates and hand holds which preferably are molded of a plastic composition and which may incorporate metallic particles for use with magnetic educational elements. The wall panels, wall plates and hand holds are all constructed and arranged to provide a versatile and adjustable climbing wall assembly that permits a plurality of climbing routes to be created and which allows markings to be made on the wall panel surfaces and magnetic or metallic elements to be easily placed and moved by climbers for recreational and educational use.

Although the prior art teaches the use of wall structures and hand holds that are used for climbing purposes and other prior art discloses the use of magnetic elements with respect to hand holds, these prior art devices are restricted and limited in use and do not disclose or suggest the climbing wall assembly and components of the present invention. The combination of the molded wall panels, hold or wall plates and hand and foot hold structures having markable and erasable surfaces and/or surfaces with metallic or magnetic properties for use with magnetic or metallic elements are not provided in the prior art. A need exists in the wall climbing art for such climbing wall assemblies. There is a further need to provide a magnetic surface on a climbing wall in an inexpensive, effective and easy manner.

The present invention provides a climbing wall assembly that is versatile and permits numerous climbing routes to be created and utilized for educational purposes. Further, the present invention provides inexpensive and easy to apply magnetic and metallic surfaces to climbing wall surfaces and associated components.

SUMMARY OF THE INVENTION

The magnetic climbing wall assembly of the invention comprises a plurality of wall panels, wall plates, hand holds and educational elements that permit numerous climbing routes to be created and used for educational purposes. The climbing wall assembly may include adjoining wall panels with markable surfaces that are adapted for easy erasure and/or molded wall panels having a surface with metallic or magnetic properties for use with magnetic or metallic, educational elements. The climbing wall assembly further comprises the use of wall plates and hand holds which are preferably molded of a plastic composition which may incorporate embedded metallic or magnetic particles for use with educational elements having magnetic or metallic properties. The invention further comprises a metallic or magnetic coating or paint layer for a climbing wall structure surface and/or for associated climbing wall components, such as hand holds, wall plates, educational elements and the like. The paint layer may also provide a writing surface for chalk and other markings to simulate blackboard and whiteboard surfaces.

The educational climbing wall assembly of the invention comprises wall panels, wall plates and hand holds which are constructed and arranged to provide a climbing wall assembly that permits climbing routes to be created and changed and which permit associated magnetic and metallic structures to be placed and moved on the wall assembly elements for recreational and educational purposes.

The wall panels of the invention include molded structures which have mounting means to receive wall plates and hand holds at a plurality of predetermined positions. Alternative wall panel structures are also disclosed. Further, the wall panels have exterior surfaces which may receive chalk markings, magnetic or metallic structures and adhesive structures, such as stickers, tape, laminates, and easy to remove markings such as those from a dry erase marker or write-on and wash off marker. Further provided by this invention are methods of manufacturing the wall panels, wall plates and hand hold structures of the invention.

The wall or route plates used in the climbing wall assembly of the invention are designed and constructed for use in educational climbing wall activities. The wall or route plates may be mounted between the climbing wall and the climbing hand hold and/or mounted separately to the climbing walls. For example, 30-50 route plates may be used on a 40-foot traverse climbing wall structure and to provide a number of designated climbing routes, i.e., beginner, intermediate and advanced routes.

The climbing routes may be identified by varying colors, geometric shapes and/or markings to provide young climbers with the ability to improvise various climbing games using colors, numbers, letters, words, shapes, animal figures, maps, pictures and symbols, i.e. mathematical symbols and the like.

The wall plates may also be provided with apertures to receive inset discs and which are preferably brightly colored and are easily visible to climbers. The different colored discs may be utilized to differentiate varying climbing routes. For example, hand holds that are marked with green discs may provide a beginner climbing route and hand holds that are marked with red discs may provide an advanced climbing route. Alternatively, the colors may be used to signify or identify a particular climber that created the route. Route setting and resetting is an integral part of utilizing the climbing wall assembly of the invention for educational and recreational purposes.

Another application for the route wall plates may involve using lettered and numbered discs. For example, discs having a complete alphabet set (A-Z), numbers 0-9, words and symbols, i.e. mathematical, musical, geometrical, geographical and scientific symbols, may be utilized in the present invention. Use of the numerical and letter discs facilitates spelling and number games on the climbing wall and eliminates the difficulty and inconvenience of creating and using paper letters and numbers tucked under the hand holds. The letters and numbers on the discs are preferably raised and textured and mounted on a geometrically shaped body, such as a rigid urethane, flexible rubber or other body structures, so that the discs may be easily inserted and removed by the climber. The discs may be molded in a one piece structure (body and letter or number) such as of a molded urethane structure or the like, for example.

A climbing wall improvement provided by the present invention includes a climbing wall surface having magnetic or metallic properties wherein the magnetic or metallic properties are provided by applying a paint layer or coating having particles with metallic or magnetic properties mixed therein. The paint may be acrylic, enamel or other known type of paint media, which may also provide a writable surface. The paint layer may be sprayed, brushed, rolled or applied in any known manner on the surface of wall panels, i.e., on plywood or concrete walls, for example. The coating or paint layer may be applied to other surfaces or substructures relating to climbing walls, for example, onto wall plates, hand holds or a block or concrete gymnasium wall. The magnetic or metallic climbing wall surface layer permits educators and students to place and remove magnetic or metallic objects for educational uses. Magnetic or metallic objects may also be used with climbing routes for math and language related activities, for example.

These and other benefits of this invention will become clear from the following description by reference to the drawings.

DESCRIPTION OF THE PREFERRED EMBODIMENTS

The magnetic climbing wall assembly of the invention comprises a plurality of wall panels, wall plates, hand holds and educational elements that permit numerous climbing routes to be created and used for recreational and educational use. The climbing wall assembly includes a climbing wall such as one formed by adjoining molded wall panels having exterior surfaces adapted to receive easily erasable markings and/or having metallic or magnetic properties for use with magnetic or metallic, educational elements. The climbing wall assembly further comprises the use of wall plates and hand holds which may be molded of a polymeric or plastic composition which incorporate embedded metallic or magnetic particles for use with magnetic or metallic educational elements. The magnetic or metallic and writable surface qualities of the wall panels, wall plates and hand holds may also be provided by a paint or coating layer which has metallic or magnetic particles mixed therein.

In summary, the educational climbing wall assembly of the invention comprises wall panels, wall plates and hand holds that may be constructed and arranged to provide a climbing wall assembly having the ability of numerous climbing routes to be created and that permits magnetic or metallic pieces, stickers, laminates, chalk, markers and the like to be placed and moved for recreational and educational use.

Figure 1:
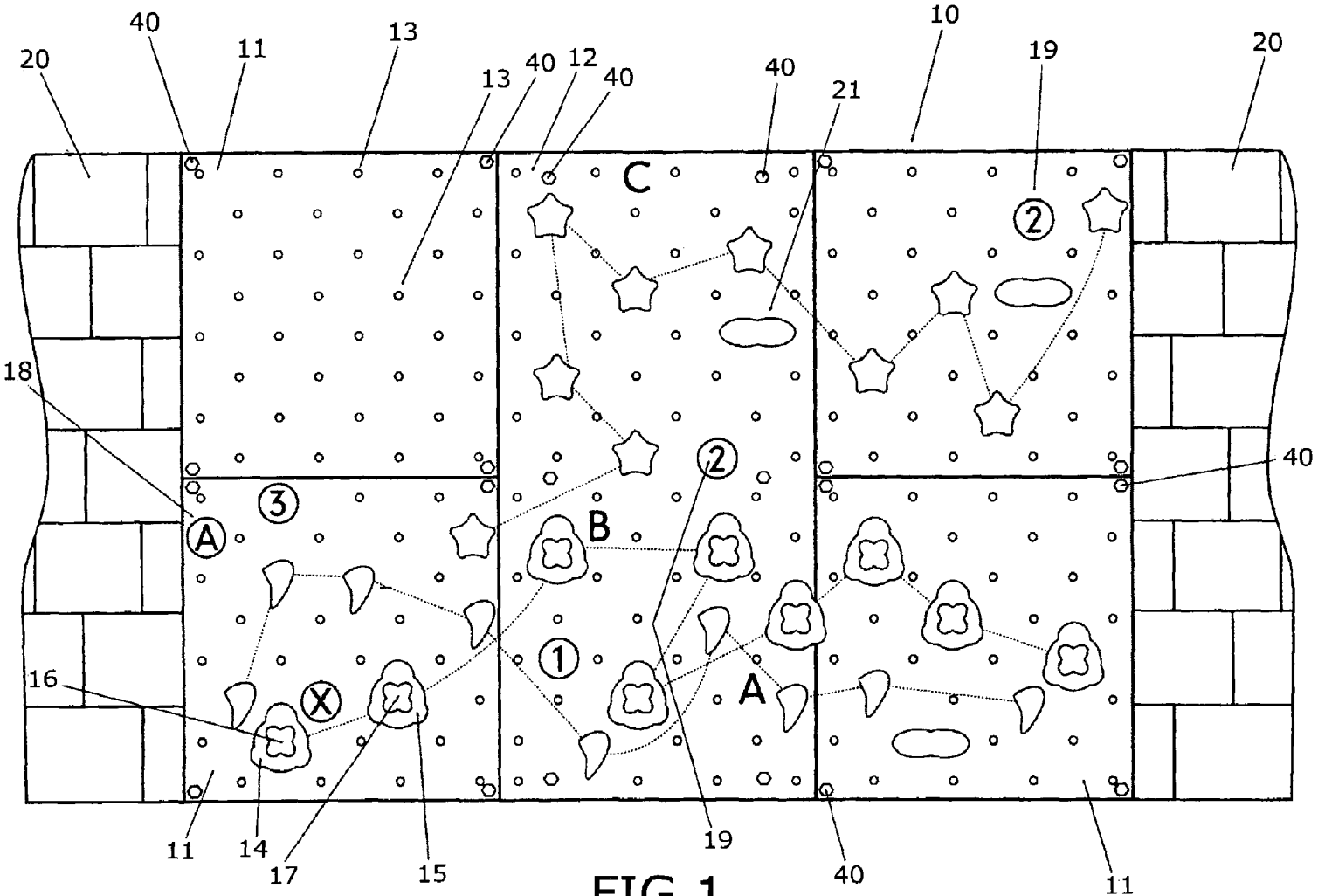
FIG. 1 is a plan view showing the climbing wall assembly of the present invention mounted to a structural wall of a building.

Referring to FIG. 1, a climbing wall assembly 10 of the present invention is shown mounted to structural wall 20. For example, the climbing wall assembly 10 may be mounted by means of bolts 40 to a concrete block or other wall structure in a school gymnasium for example. The structural wall may be provided with wooden members attached to a concrete or like wall, for example, and to which the climbing wall assembly 10 is mounted. Alternatively, the wall assembly 10 may be mounted to a free standing structural member or the climbing wall may be created directly on a concrete block wall or like wall structure.

Figure 2:
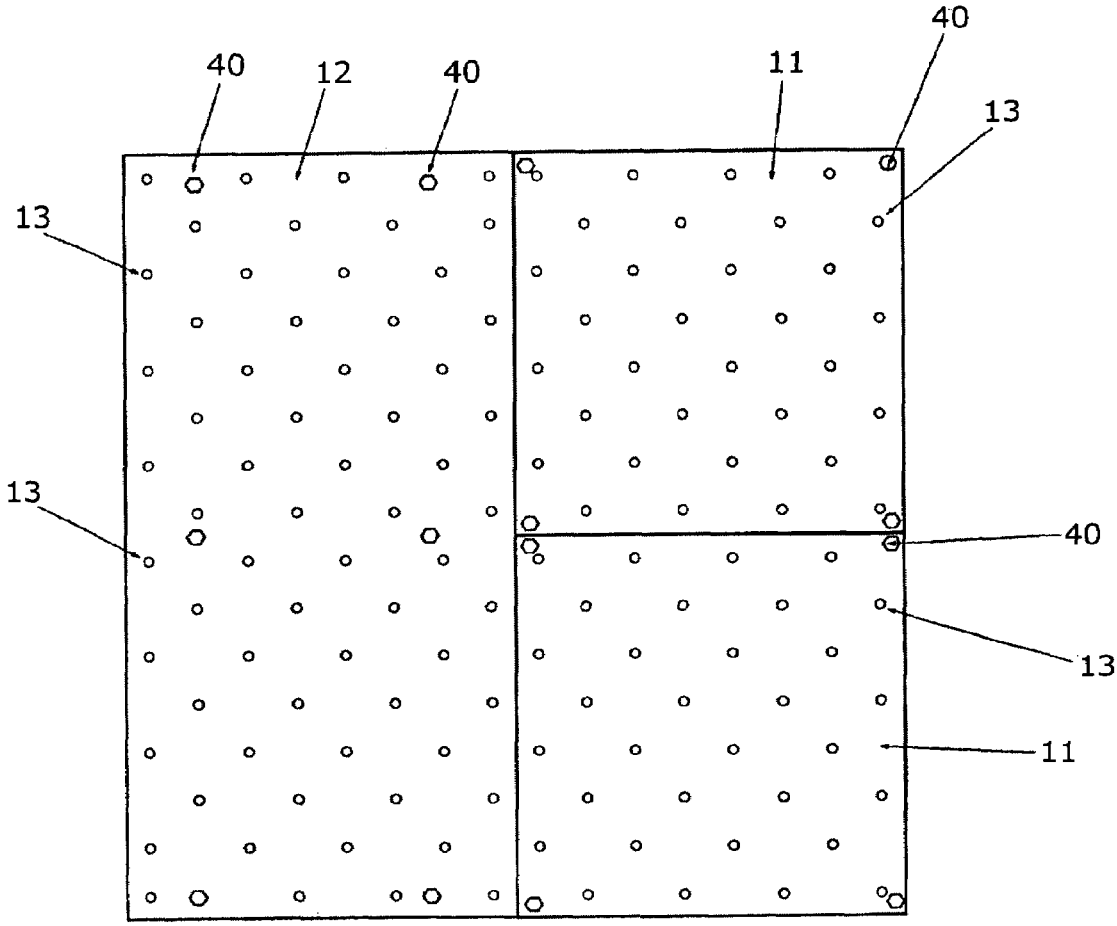
FIG. 2 is a plan view showing adjoining wall panel structures of the present invention.

Referring to FIGS. 1 and 2, the climbing wall assembly 10 is shown comprised of a plurality of adjoining individual wall panels 11 and 12. For example, the wall panels 11 may be 4 ft.×4 ft. sized panels and panels 12 may be 4 ft.×8 ft. sized panels. These rectangular wall panel areas are exemplary of wall panels that may be joined adjacently to form a climbing wall. The individual panels 11 and 12 are shown mounted in a side by side arrangement and may be of any height and length to accommodate a particular building wall area or to provide a climbing wall having a particular area, i.e., 40 ft. long and 8 ft. high.

Each wall panel 11 and 12 is shown to have a plurality of apertures 13 which are shown in a predetermined pattern covering the entire area of an individual panel. These apertures 13 have means to connect the wall plate structures 14 and 15 and hand holds 16 and 17 to the individual wall panels. The pattern of apertures 13, thereby permit the wall plates and hand holds to be mounted to wall panels in any desired pattern to thereby permit a multiplicity of climbing routes to be created. Wall panel 12 is shown having a plurality of spaced apertures 13 which are arranged in a pattern and positioned and adapted to receive the wall plates and hand hold structures. Each aperture 13 preferably has means, such as a T-nut structure fixed therein or having other fastening means, for mounting the wall plates and/or hand hold structures to the climbing wall surface. Further, fastening bolts 40 are shown for securing the wall panel 12 through wall panel mounting apertures to a building wall structure, if desired. The wall panels may be otherwise secured to a wall by known means or alternatively mounted to a free standing frame structure or other substructure. For example, expandable, threaded, sleeve/bolt fasteners or an elongated bolt/nut fastener may extend through a concrete or block wall to fasten hand holds, wall plates, and like elements Referring to FIGS. 1 and 3, an individual wall panel 11 may have a number of educational elements which are movably attached to either the surface of the wall panel 11 or to the components mounted to the wall panel 11, i.e., wall plate 15 and hand hold 16. For example, as shown, magnetic geometric shapes 36, magnetic letters 18, 26 and magnetic numerals 19, 27 may be attached to the surface of wall panel 11. Further, as shown, wall plate structure 15 may have removable letter insert 24 therein. The hand hold 16 and wall plate 15 structures are shown mounted to the wall panel 11. Individual hand hold structures 21 are also shown mounted to wall panel 12.

Figure 3:
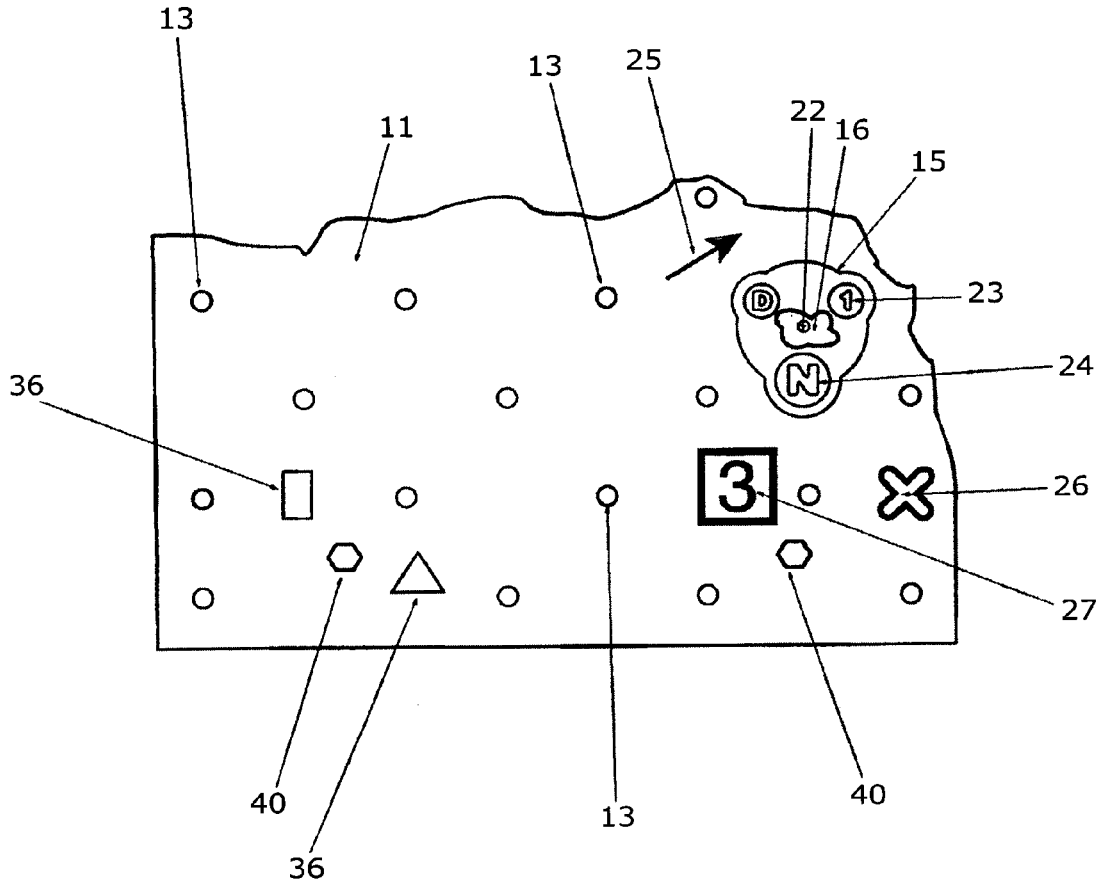
FIG. 3 is a plan view showing a wall panel, a plate structure, hand hold and educational elements of the invention.
Figure 4:
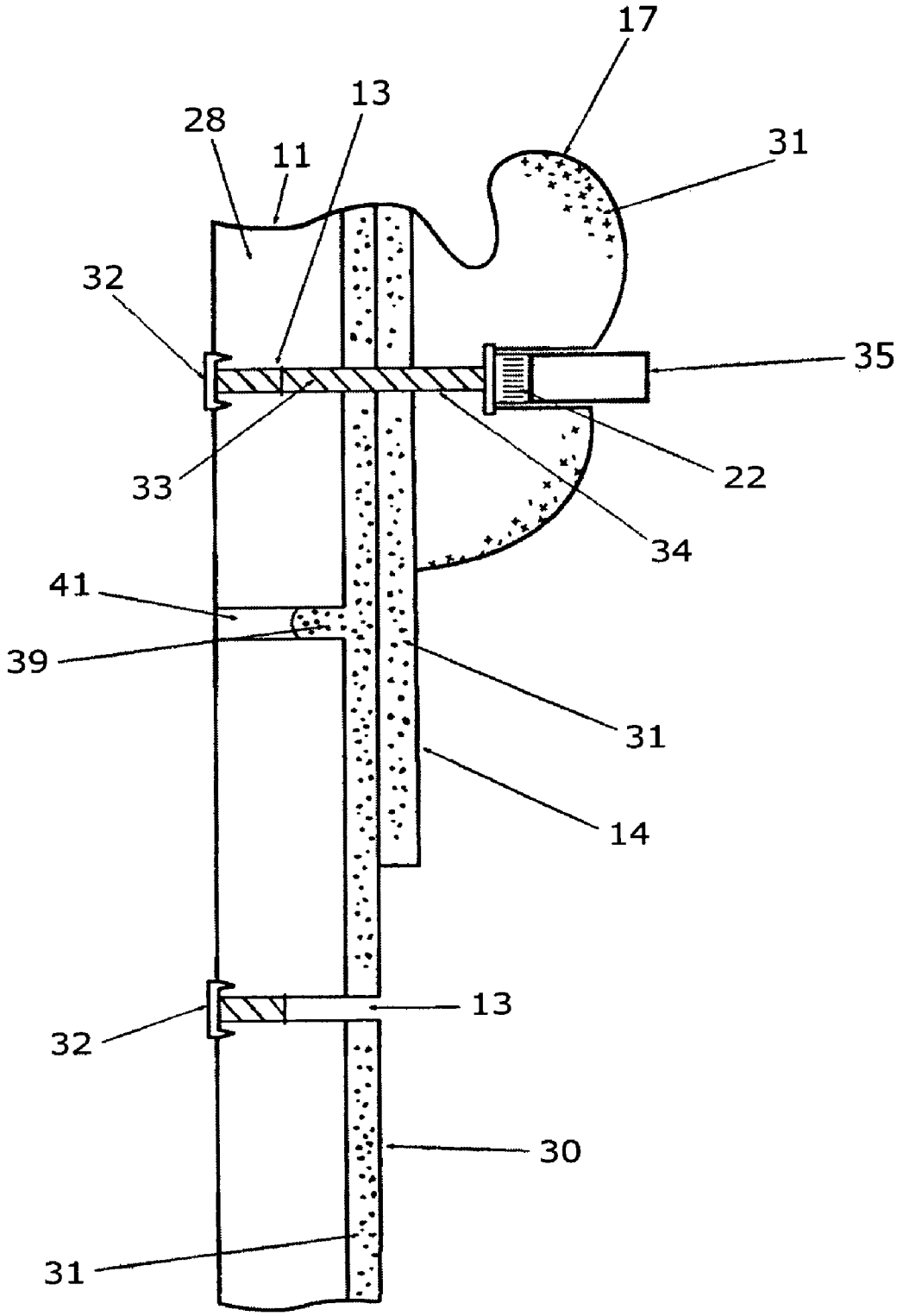
FIG. 4 is a sectional view of a wall panel of the present invention.

FIG. 4 is a sectional view showing the wall panel 11 and the wall plate structure 14 and hand hold 17 mounted to the wall panel 11. The wall panel 11 is shown comprised of a base structure 28, i.e., a sheet of plywood (¾ inch thickness, for example) and an outer layer 30 molded to the base structure 28. The outer layer 30 is preferably of a urethane or similar plastic composition, for example. The surface of the plastic layer 30 may also be constructed to receive markings 25, for example, as shown in FIG. 3, to thereby allow a climber to physically mark a route. The molded wall panel 11 is further shown having a plurality of T-nuts 32 attached to the back of the base structure 28 and positioned in apertures 13. T-nuts 32 are metallic structures having internal threads for receiving bolts 33 having bolt heads 22. The bolts 33 are shown to attach the hand holds 17 and wall plates to the wall panel 11. As further shown, a magnetic rod elements 35 may be used on bolt head 22 of bolt 33 and to extend from the hand hold 17 for marking use by climbers.

Figure 8:
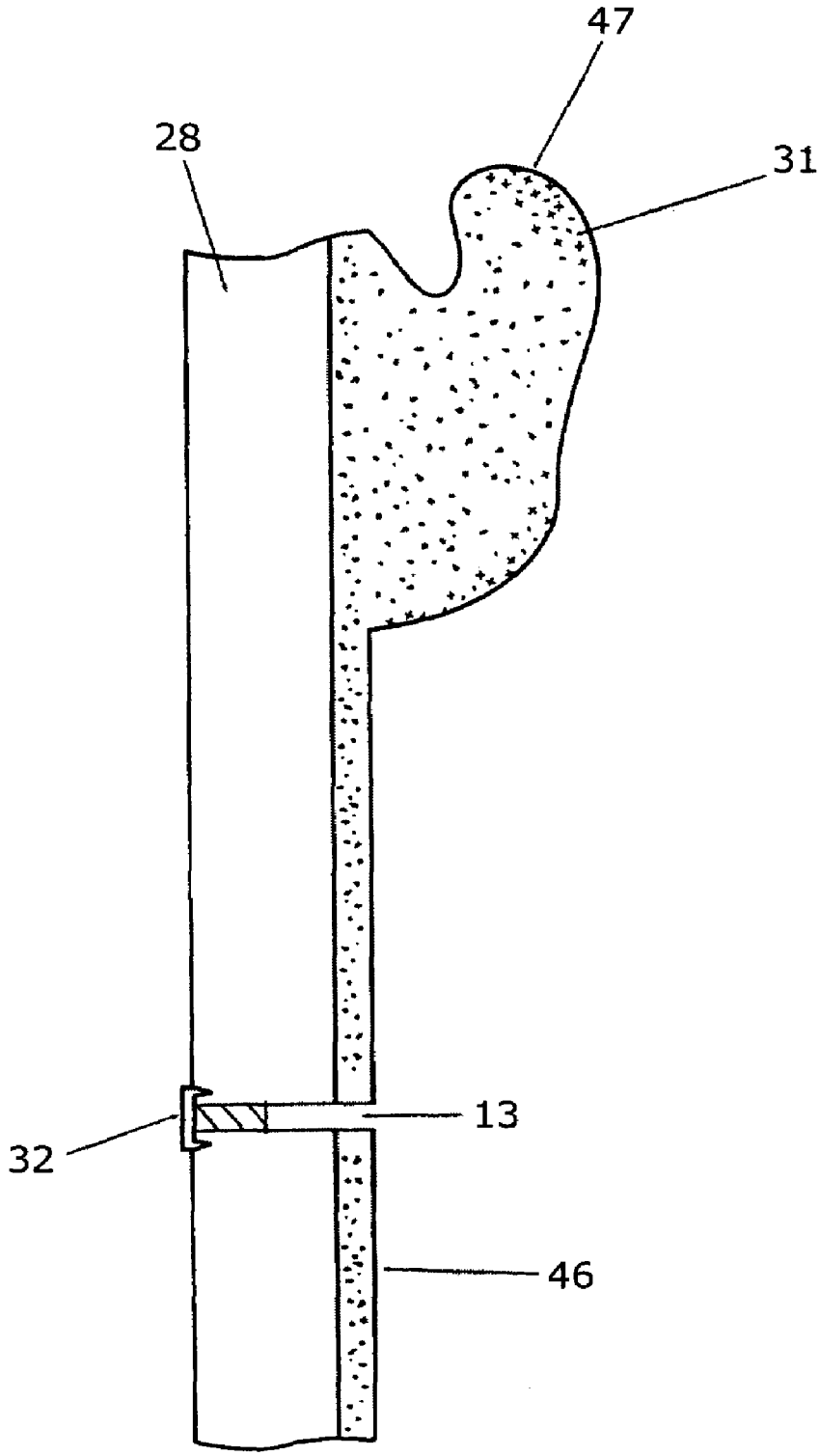
FIG. 8 is a sectional view showing another wall panel embodiment.

One embodiment of the wall panels 11 and 12 are preferably molded in an operation that generally comprises mixing a two part urethane resin, for example, and pouring the liquid resin in a mold, such as a silicone mold. Next, a base member 28, for example, a sheet of ¾ inch plywood, MDF (medium density fiberboard), a sheet of plastic, a sheet of metal, a sheet of composite wood/plastic or a combination thereof is placed on top of the urethane mixture in the mold. Upon curing of the urethane mixture, the wall panel is formed. In molding the wall panels 11 and 12 the bottom surface of the mold preferably has spaced protrusions extending therefrom to form apertures or holes in the outside surface of the urethane layer 30 and which are subsequently used to drill through the base structure 28 to form the apertures 13 in the wall panels 11 and 12. Alternatively, the wall panel may be formed of a one piece molded plastic structure. This process or other molding processes may also be utilized to provide wall panels having molded handhold structures unitary with the panels, as shown in FIG. 8.

Figure 5:
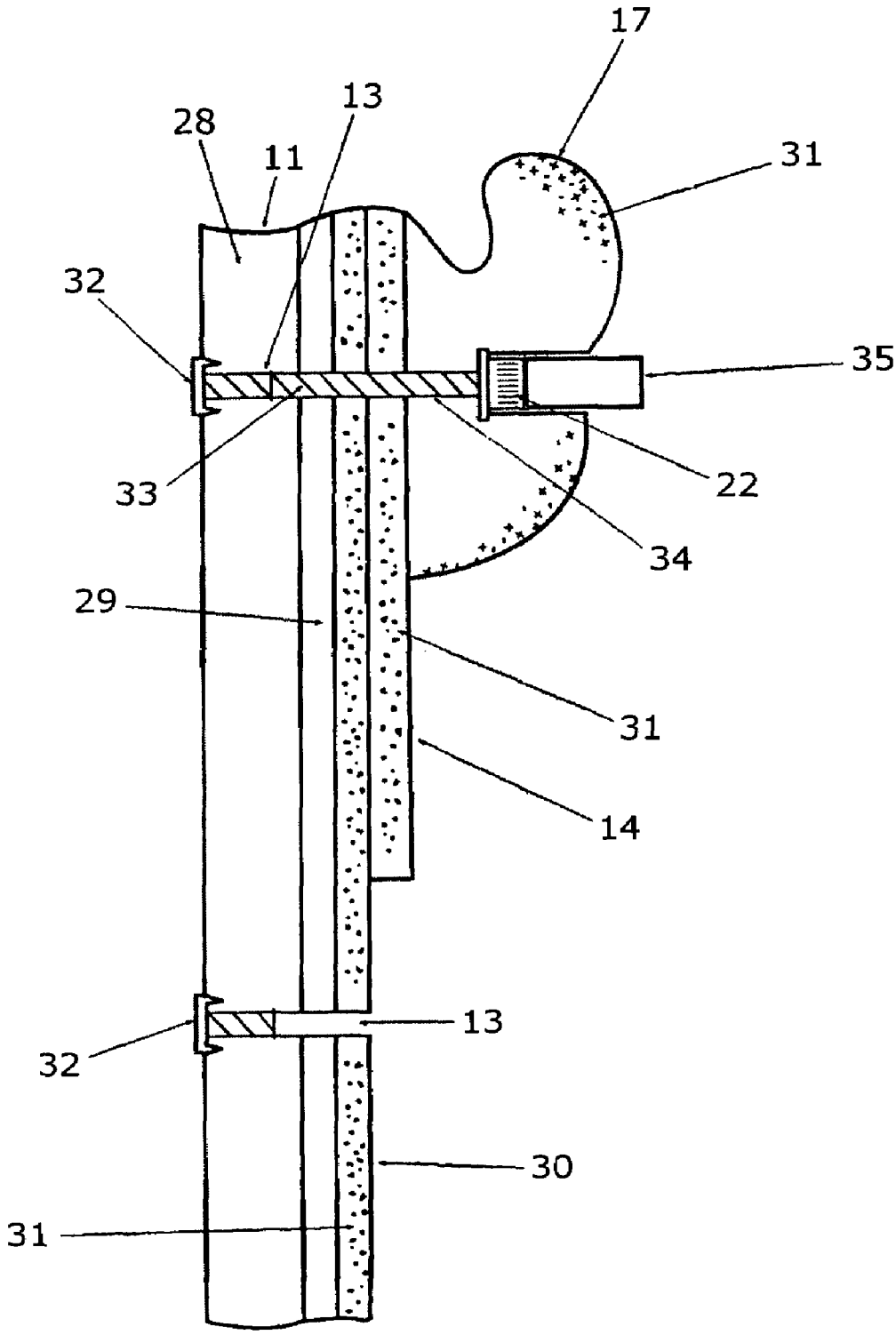
FIG. 5 is a sectional view showing another wall panel embodiment.

As shown in FIG. 5, the base structure 28 may also be laminated to the molded urethane panels by means of a layer 29 of urethane resin. Alternatively, an adhesive or mechanical means may be used to secure the urethane panel to the base structure 28. As will be further discussed, other panels, such as writing boards may be secured to the base structure 28 to form a wall panel.

In the above referenced molding process, the base structure 28, i.e., plywood panel, is initially provided with a plurality of apertures 41 to provide air holes (i.e. randomly or uniformly spaced apertures in the base structure) to thereby provide the nubs 39 in the molded urethane 30 and which protrude into the air holes 41 and also to aid in securing the urethane panel and base member together, as shown in FIG. 4. The mold used in the manufacture of the wall panels, wall plates and hand holds are preferably constructed of a silicone structure or the like. The mold may further have a smooth or rough surface, may be flat or planar or may have a profile to assimilate a rock form. The wall plates and hand hold structures are also formed in a mold of a urethane resin, however, the wall plate and hand hold members do not utilize a base member, i.e, plywood, and instead are comprised of a molded urethane structure, or like molded plastic.

The urethane resin preferably has metallic particles, such as pellets or the like, mixed therein so that the molded panel, plates and hand holds will have metallic properties. In addition or alternatively, the metallic elements may be dropped into the resin after the resin has been poured into the mold.

Although the wall panels of the invention and the process of manufacturing the wall panel, hand holds and wall plates are described as having metallic particles placed therein for subsequent use with magnetic elements, magnetic walls, hand holds and plates may be used instead and the educational pieces may have metallic or magnetic elements incorporated therein for use with the magnetized panels, plates and hand hold elements. Regarding the magnetic elements used in the invention, preferably earth magnets are utilized for their magnetic strength. Metallic objects may be used on wall surfaces and on surfaces of associated elements having magnetic properties, i.e., on handholds, wall or route plates, etc. Magnetic objects may be used on these surfaces having metallic properties or magnetic properties of opposite polarity.

Referring further to FIG. 4, the outer urethane layer 30, the plate structure 14 and the inner surface of the hand hold 17 are shown to have metallic particles 31 embedded therein so that magnetic pieces may be held thereto according to the teachings of the present invention.

The wall panel exterior surfaces of the present invention are constructed and arranged to have educational writing board capabilities. These surfaces include chalkboard, i.e., blackboard and "white board" surfaces, either with metallic and/or magnetic qualities to thereby provide marking capability as well as providing the use of magnetic and/or metallic educational elements. Acrylic or enamel paints or coatings may also be utilized to create these surfaces.

The markers that may be utilized with the writing board surfaces may include dry erase, write-on/wash-off type markers, crayons, pens, pencils, removable paint and like markers. The latter marking devices are utilized by and familiar to students and such and like writing utensils are preferred for use with this invention. Further, stickers may also be utilized such as those having adhesive release qualities.

Figure 12:
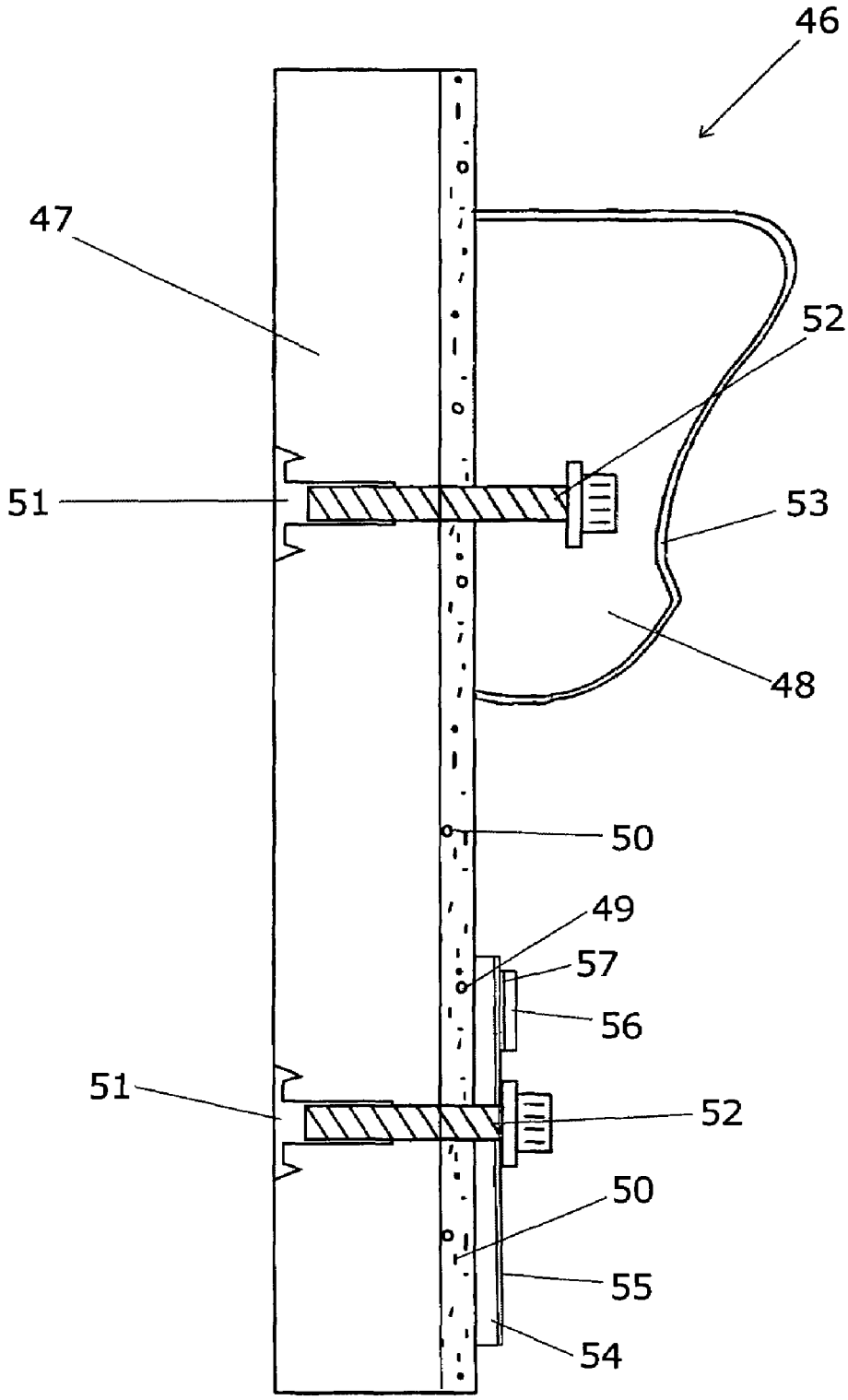
FIG. 12 is a sectional view showing a climbing wall panel, handhold structure, wall plate structure and educational element each having a painted layer with magnetic or metallic particles embedded therein.

Although writing boards having hard glossy surfaces, such as a plastic, melamine or porcelain composition are often referred to as "white boards", such surfaces may be provided in any desired color. Likewise, chalkboards having smooth surfaces usually made of slate, glass or wood compositions for crayons or chalk are often referred to as "black boards", may also be provided in any desired color. These writing board surfaces although normally flat, may also be contoured and may include formed handhold structures. Further, these writing surfaces may be placed onto a base structure via lamination, paint spray, or the like and may include an underlying layer of a metallic or magnetic composition whereby both writing and magnetic and/or metallic educational elements may be utilized by the climbers. Alternatively, as shown in FIG. 12, the exterior layer may be a paint or coating layer having metallic or magnetic particles mixed therein to provide an exterior surface with magnetic or metallic properties.

Figure 6:
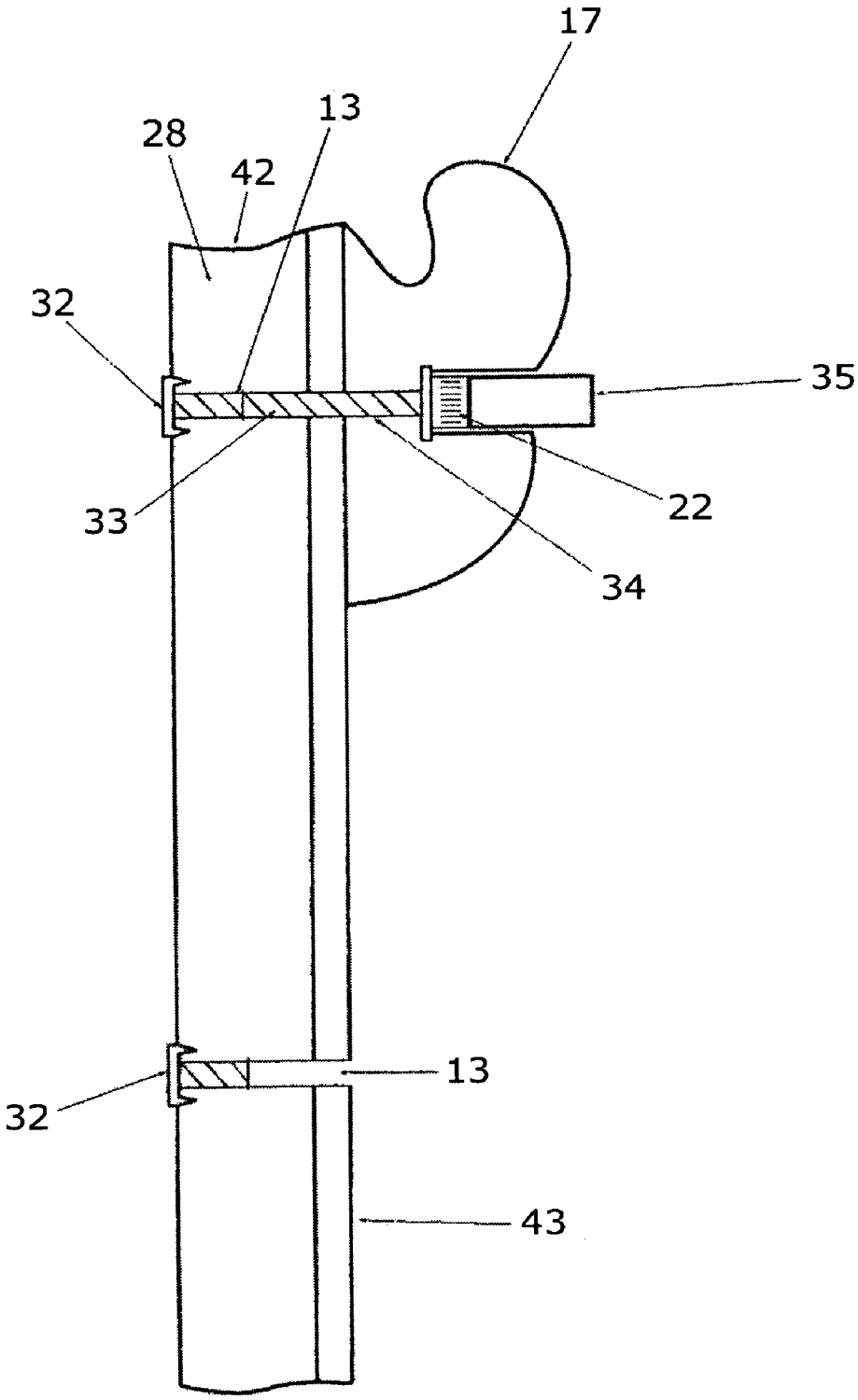
FIG. 6 is a sectional view showing an alternative wall panel embodiment.

FIG. 6 is a sectional view showing wall panel 42 having base structure 28 having a "chalkboard" surface 43 affixed thereto. The surface 43 may be fixed by means of adhesive or other fastening means to the base structure 28, i.e., a sheet of plywood or other base structure. Apertures 13 having T-nuts 32, or other fastening means, are similarly shown having hand hold 17 mounted to the wall panel 42.

Figure 7:
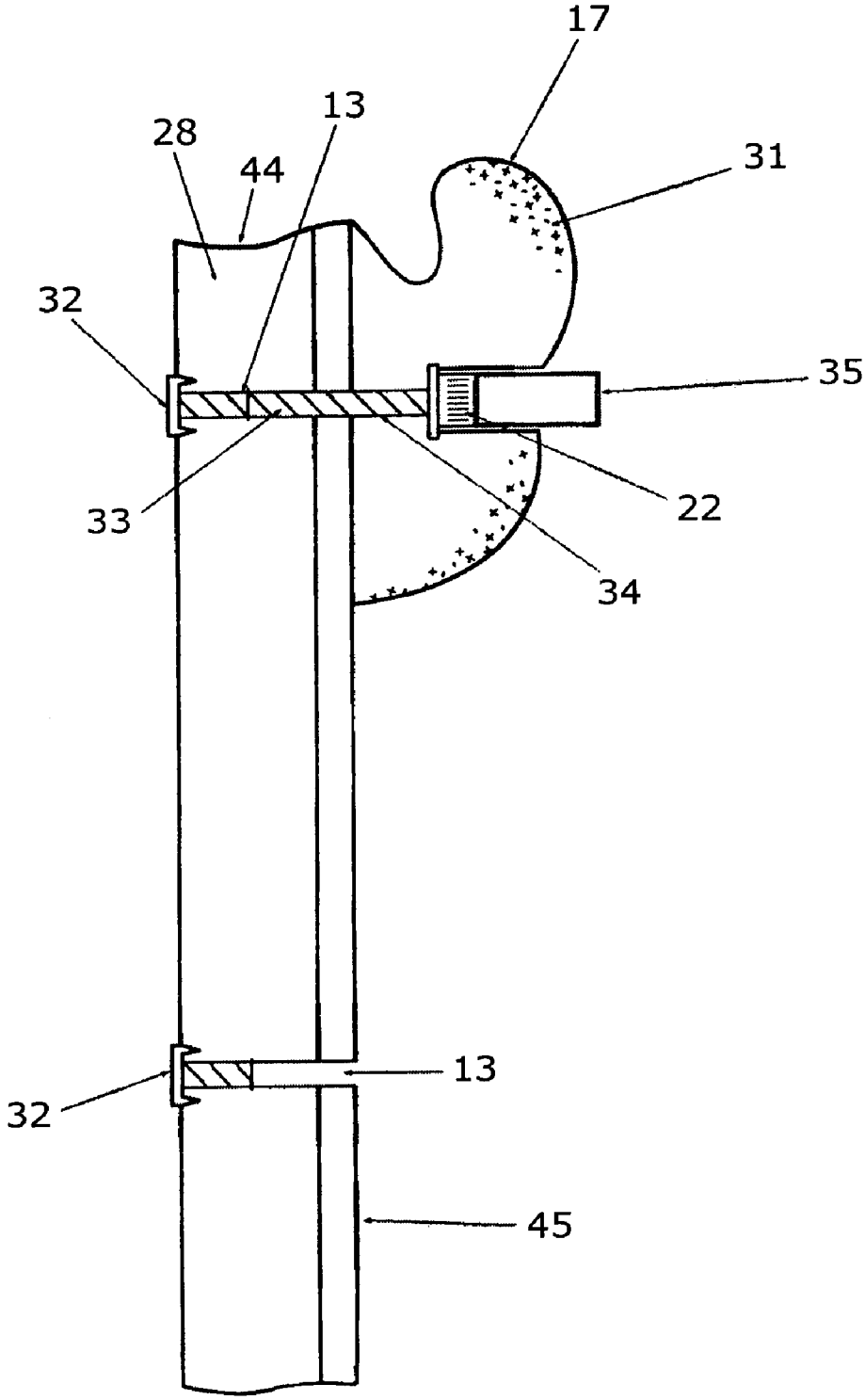
FIG. 7 is a sectional view showing another wall panel embodiment.

FIG. 7 is a sectional view having wall panel 44 having a base structure 28 having a "white board" surface 45 affixed thereto. The white board surface 45 is a hard impermeable plastic material adapted to receive markings, i.e., from erasable markers utilized in classrooms, for example.

The climbing wall assemblies of the invention may include adjoining wall panels having like exterior surfaces or adjoining wall panels having different exterior surfaces. The latter wall panel different surface arrangement, whether different in color, different in marking ability, or having different properties, i.e. magnetic, non-magnetic, can be utilized for educational purposes; for example, identification of the different surfaces by the climbers via the use of the appropriate corresponding educational elements by placement on specific wall surfaces.

FIG. 8 is a sectional view showing base structure 28 having molded layer 46 attached thereto. Importantly, hand hold structure 47 is shown unitarily molded with layer 46. Alternatively, base structure 28 may be eliminated by increasing the thickness of molded layer 46 to thereby provide a structural element. Further, metallic particles 31 are shown in layer 46. As discussed, magnetic particles may also be utilized in layer 46 or a metallic or magnetic layer may be disposed between base structure 28 and molded layer 46 to yield metallic or magnetic properties for use with corresponding educational elements. T-nut 32 is shown positioned in aperture 13 whereby wall plates, for example, may be mounted to the structure.

Figure 9:
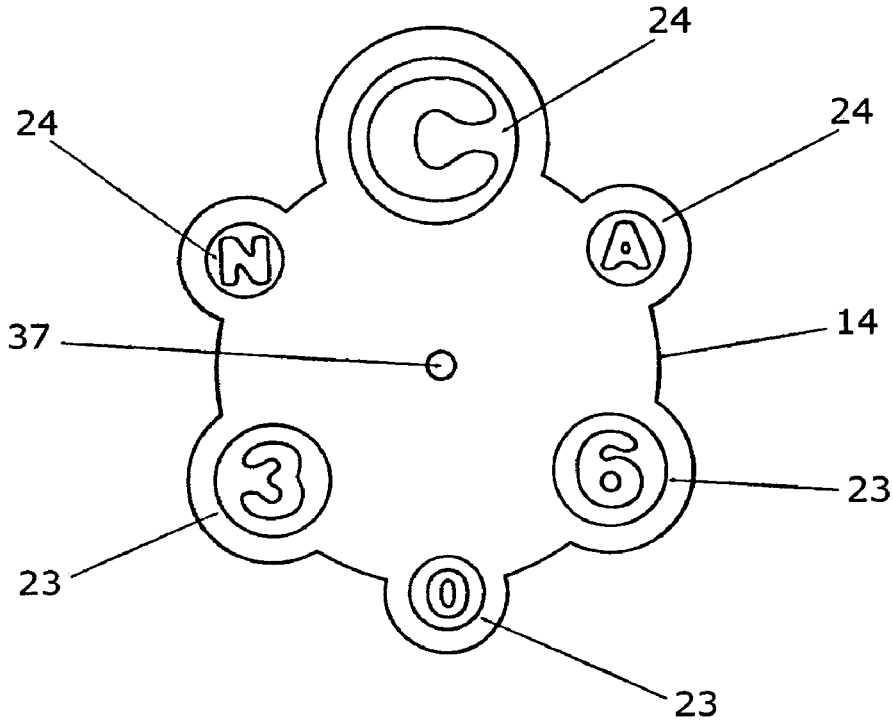
FIG. 9 is a plan view showing a plate structure used in the climbing wall assembly of the invention.
Figure 10:
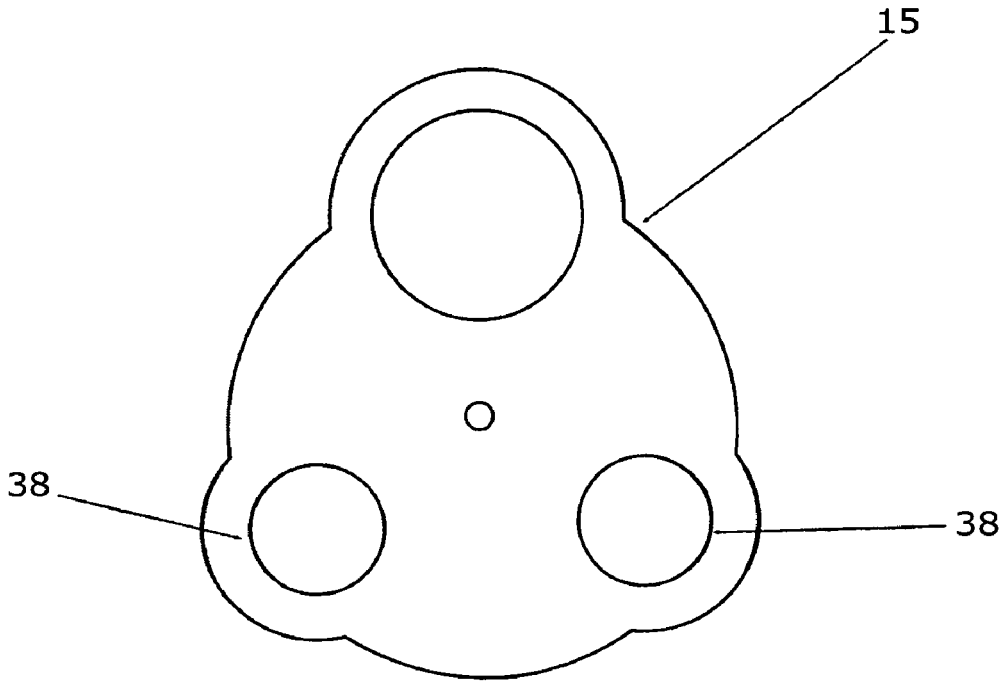
FIG. 10 is a plan view showing another plate structure used in the climbing wall assembly of the invention.
Figure 11:
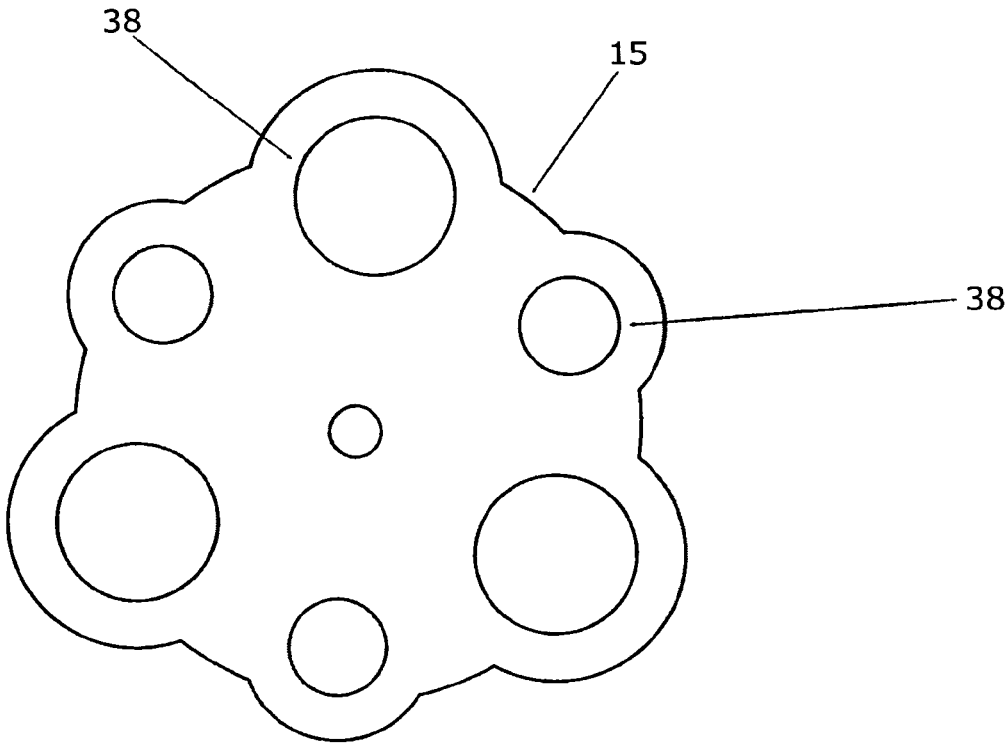
FIG. 11 is a plan view showing another plate structure used in the climbing wall assembly of the invention.

FIG. 9 is a plan view showing a wall plate structure 14 having a geometric shape having an aperture 37 for mounting the wall plate 14 to a wall panel 11, for example, and having a plurality of removable numerical insert discs 23 and a plurality of removable letter inserts 24 which are placed in circular apertures in the periphery of the wall plate structure 14. Further, FIGS. 10 and 11 show other geometrically shaped wall plates 15 having peripheral apertures 38 for receiving the numerical and letter inserts.

The route plates 14, 15 used in the climbing wall assembly 10 of the invention are designed for use in educational climbing wall activities. The wall or route plates 14, 15 may be mounted between the climbing wall panel 11 and the climbing hand hold 16. The route plates 14, 15 are affixed to the wall panel 11 in a similar manner as a hand hold, for example, with a ⅜, 16 thread socket head cap screw, i.e., bolt 33. Each bolt or screw 33 passes through an enlarged aperture 34 of a hand hold structure 17. This dimension may be larger than a standard hole or may be slotted to enable the wall plate 14, 15 to be adjusted so that the hand hold 17 does not cover any of the discs 23, 24, six for example, and so that each plate 14 can be separated from nearby plates, i.e., 15. For example, 30-50 route plates 14, 15 may be used on a 40-foot traverse climbing wall.

FIG. 12 shows the climbing wall structure 46 of the present invention comprising wall base member 47 with a paint layer 49 having particles 50 mixed therein. The wall base member may be constructed of ¾ inch plywood or a like base material. The paint particles 50 may be metallic or a magnetic particles which set within the dried paint or coating layer. Hand hold 48 is shown attached to wall base member 47 by means of a T-nut 51 and cooperating bolt 52. The hand hold 48 is shown having an exterior surface 53 which has magnetic or metallic particles. Further, a wall plate 54 is shown having and exterior surface 55 having magnetic or metallic particles. An educational element 56 having an exterior surface 57 with magnetic or metallic particles is shown used on wall plate 54. The paint layers 49, 53, 55 and 57 may be acrylic, enamel or other type of paint media and may be sprayed, brushed, rolled or otherwise applied on the climbing wall surface. These paints or coatings may also provide writable surfaces as described above. The paint layer with the magnetic or metallic particles may also be applied to any surface or substructure, for example, a wall plate, a hand hold, a plywood climbing wall or a block or formed concrete gymnasium wall. The painted climbing wall and component surfaces permit educators and students to place and remove magnetic objects for educational purposes as described herein. Magnetic or metallic objects may be used in climbing routes and marked for math, language or other educational activities that may be conducted and played.

The wall plate structures of the present invention may also be utilized on any other climbing wall structures. For example, the wall plate structures and associated educational elements, whether metallic, magnetic or frictional fit may be mounted via any fastening means, i.e., mechanical, adhesive, etc., to known wall climbing structures to provide educational aspects and uses by young climbers, for example.

After attachment to the wall panels 11, the wall plates 14 and the inset discs 24, which are preferably brightly colored, are easily visible to climbers. The different colored discs 24 may be utilized to differentiate varying climbing routes, i.e., A, B, C or to designate the difficulty of the route. For example, hand holds "marked" with green discs may show a beginner climbing route, i.e., route A, and holds "marked" with red discs may show an advanced climbing route, i.e., route C. Alternatively, the colors may be used to signify a particular climber that created the route. Route setting and resetting is an integral part of utilizing the climbing wall assembly 10 of the invention for educational and recreational purposes.

Another application for the route wall plates involves using lettered discs 24 and numbered discs 23. For example, a complete alphabet set (A-Z) and the numbers 0-9 may be utilized in the present invention. Use of the numerical discs 23 and letter discs 24 facilitates spelling and number games on the climbing wall and eliminates the difficulty and inconvenience of creating and using paper letters and numbers tucked under the hand holds. The letters and numbers on the discs 23, 24 are preferably raised and textured and mounted on a body having a predetermined size and shape, so the discs are easily inserted and removed by the climber.

The wall route plates 14, 15 may be approximately 0.25" thick and approximately 8 inches wide and 10 inches long.

Each route plate 14, 15 may have six removable discs (i.e., 23, 24), for example, set inside and along the outer edges of the plastic plate structure 14 as shown in FIG. 9. The diameters of the discs may be as follows: one at 3", two at 2" and three at 1.25". The discs 23, 24 may have six different colors, for example. Smaller versions and other shapes of the wall route plate may also be utilized.

As many changes are possible to the embodiments of the assemblies of this invention utilizing the teachings thereof, the descriptions above, and the accompanying drawing should be interpreted in the illustrative and not in the limited sense.

That which is claimed is:

1. A climbing wall assembly comprising:

a) at least one fixed wall panel constructed and arranged to be joined by adjacent fixed wall panels, said at least one wall panel having an exterior surface adapted for educational use and further having a plurality of spaced apertures with mounting means for providing means to create a plurality of climbing paths, said exterior surface of said wall panel having a paint layer with particles with metallic or magnetic properties;

b) at least one hand hold structure having means to attach to the mounting means of one said spaced apertures with mounting means in said at least one wall panel; and c) at least one wall plate member having an aperture therethrough and being constructed and arranged for mounting to the mounting means of an aperture of said at least one wall panel, wherein said wall plate member has an exterior surface consisting of a paint layer with metallic or magnetic properties.

2. The climbing wall assembly of claim 1, wherein said hand hold structure further has an exterior paint layer with metallic or magnetic properties and further wherein said paint layer provides a writable surface.

3. The climbing wall assembly of claim 1, wherein a plurality of educational elements are provided, said educational elements being removable and including removable element shapes depicting numbers, letters, words and geometric shapes, and said educational elements having exterior surfaces comprising a paint layer with metallic or magnetic properties.

4. The climbing wall assembly of claim 1, wherein said at least one wall plate and said at least one hand hold are molded of a polymeric material.

5. The climbing wall assembly of claim 1, wherein said at least one wall panel further has means to mount said wall panel to a concrete block or other wall structure and wherein said wall panels have a predetermined area selected from the predetermined wall panel areas consisting of 4 ft.×1 ft., 4 ft.×2 ft., 4 ft.×4 ft., 4 ft.×8 ft. and 4 ft.×10 ft. in area and wherein said means to attach said hand hold structure comprises a T-nut structure.

6. A climbing wall assembly comprising:

a) a climbing wall having at least one mounting aperture with a cooperating fastening element, said climbing wall having an exterior surface comprising a paint layer with magnetic or metallic properties adapted for educational use;

b) at least one hand hold structure having a body having a generally flat mounting surface and a curved exterior grabbing surface extending from said generally flat mounting surface, wherein said body has at least one bore therein and wherein said hand hold body is secured to said climbing wall having said generally flat mounting surface abutting the wall surface and having a fastener extending through said hand hold body bore in cooperation with said fastening element of said climbing wall aperture;

c) a plurality of educational elements each having an exterior surface portion having metallic or magnetic properties, said metallic or magnetic exterior surface portion constructed and arranged to cooperate with said magnetic or metallic paint layer of said climbing wall so that said educational elements are readily attachable to and removable from said climbing wall, said educational elements including removable numbers, letters, words and geometric shapes; and d) at least one wall plate member having an aperture therethrough and being constructed and arranged for mounting to said climbing wall, said wall plate having an exterior surface comprising a paint layer having metallic or magnetic properties.

7. The climbing wall assembly of claim 6, wherein said hand hold structure further has an exterior paint layer having metallic or magnetic properties.

8. The climbing wall assembly of claim 6, wherein said climbing wall has a plurality of mounting apertures therethrough for providing means to create a plurality of climbing paths and further wherein said fastener is a bolt member.

9. The climbing wall assembly of claim 8, wherein said cooperating fastening structure comprises a T-nut structure.

10. The climbing wall assembly of claim 6, wherein said educational elements have an exterior surface comprising a paint layer having metallic or magnetic properties.

11. A climbing wall assembly comprising:

a) a plurality of fixed wall panels, each said fixed wall panel having a periphery adapted for abutment with an adjacent fixed wall panel, each wall panel having an exterior surface comprising a paint layer having a metallic property or a magnetic property adapted for receiving educational elements, said paint layer further providing a writable and erasable surface, each said wall panel further having a plurality of apertures, b) a plurality of educational elements including numbers, letters, words and geometric shapes, said educational elements removably cooperating with said wall panel and having a property selected from the group of properties comprising a metallic property and a magnetic property, said property cooperating with said metallic or magnetic property of said climbing wall so that the educational elements are readily attached to and removed from said exterior surface of said climbing wall panel;

c) means to secure said wall panels in an adjoining wall panel arrangement;

d) means to secure a handhold structure positioned in selected apertures of said wall panels, wherein said means to secure a handhold structure is integral the wall;

e) a plurality of handhold structures each having a body having a generally flat rear mounting surface and a front curved grabbing surface extending therefrom, wherein each mounting surface is adjacent said wall panel when said hand hold structures are arranged on said panels to form a climbing route, each handhold structure secured to a wall panel by a fastener which cooperates with said means to secure a handhold structure; and f) a wall plate structure with an exterior surface comprising a paint layer having metallic or magnetic properties, said wall plate structure having a writable and erasable exterior surface and at least one aperture therein for receiving an education element.

12. The climbing wall assembly of claim 11, wherein said property of said educational elements are provided by a paint layer thereon having magnetic or metallic properties.

13. The climbing wall assembly of claim 11, wherein said each said hand hold structure has an exterior surface comprising a paint layer having magnetic or metallic properties.

14. The climbing wall assembly of claim 11, wherein said wall panels have a predetermined panel area selected from the predetermined panel areas consisting of 4 ft.×1 ft., 4 ft.×2 ft., 4 ft.×4 ft., 4 ft.×8 ft. and 4 ft.×10 ft.

15. The climbing wall assembly of claim 11, wherein said means to secure said wall panels is comprised of a mounting aperture through said wall panel and fastening elements for extension through said mounting aperture.

16. The climbing wall assembly of claim 11, wherein said means to secure a handhold structure is comprised of a T-nut structure fixed in each said plurality of apertures.

17. The climbing wall assembly of claim 11, wherein said educational elements comprise insert discs for removable mounting in said at least one wall plate aperture.

* * * * *